United States Patent [19]

Holming et al.

[11] Patent Number: 4,715,546

[45] Date of Patent: Dec. 29, 1987

[54] GRINDING MEDIA CHARGING DEVICE

[75] Inventors: Robert Holming, Brookfield; Robert S. Nelson, Mequon; Thomas R. Daley, Nashoteh, all of Wis.

[73] Assignees: Armco Inc., Middletown, Ohio; The Holming Company, Milwaukee, Wis.

[21] Appl. No.: 17,295

[22] Filed: Feb. 11, 1987

[51] Int. Cl.[4] ..... B02C 17/18

[52] U.S. Cl. ..... 241/171

[58] Field of Search ..... 211/171, 172, 30; 222/410

[56] References Cited

FOREIGN PATENT DOCUMENTS 216428 7/1968 U.S.S.R. ..... 241/171

*Primary Examiner*—Mark Rosenbaum

*Attorney, Agent, or Firm*—R. J. Bunyard; L. A. Fillnow; R. H. Johnson

[57] ABSTRACT

An apparatus for uniformly feeding grinding balls to a grinding mill. The apparatus includes a ball storage hopper, a regulator and an inclined chute for conveying balls from the hopper to the regulator. The chute includes a panel for controlling the depth of the balls. The regulator includes a discharge drum having a plurality of compartments adapted to receive the balls, an electric motor for rotating the drum, and a means for retaining the balls in the drum. The drum is rotated at a predetermined speed and feeds the balls into a mill at a uniform rate which can be controlled to approximately match the attrition rate of the balls in the mill.

15 Claims, 6 Drawing Figures

GRINDING MEDIA CHARGING DEVICE

BACKGROUND OF THE INVENTION

This invention relates to an apparatus for feeding grinding balls into a ball mill of a type such as a generally horizontal, cylindrical drum for pulverizing raw material. More particularly, the invention relates to an apparatus for uniformly feeding a few balls at a time into a ball mill.

It is well known to pulverize iron ore, limestone, cement, coal, phosphate, copper ore and the like in rotating drums containing steel or iron balls generally ranging in size from 1 to 5 inches (25–127 mm). The raw material is crushed between the balls resulting from the cascading action of the balls as the ball mill is rotating.

The metal balls gradually wear away from the continual rubbing and impact between each other. New balls eventually must be fed into the ball mill. To operate at peak grinding efficiency, it is desirable to uniformly feed new balls into the ball mill at approximately the same rate as old balls wear out. Depending on the type balls used for grinding a specific raw material, the ball attrition rate can be accurately determined.

Raw material is normally fed into ball mills at rates corresponding to the output of the pulverized material. The input rate of raw material is frequently controlled using such parameters relating to grinding efficiency as sound, power consumption, fineness of pulverized material, etc. Using the same parameters have been proposed in the prior art for controlling feed rates of grinding balls. However, devices for uniformly feeding a few balls at a time that can correspond to the ball attrition rate in a grinding mill are not known in the art. Although new balls may be systemically added to a grinding mill, they are generally added in batches of several hundred pounds at a time. This cyclical loading of the grinding mill greatly increases the power requirements to operate the grinding mill. More importantly, the grinding efficiency of the grinding mill is decreased. Peak grinding efficiency cannot be maintained if the ratio of balls to the ore to be pulverized is not uniformly maintained.

Known devices for feeding balls into grinding mills generally are large machines which are costly to operate, frequently become jammed with balls, and/or fail to uniformly feed a few balls at a time into grinding mills. U.S. Pat. No. 3,542,300 discloses a large ball hopper for feeding balls into a ball mill. The hopper includes a number of compartments for holding balls. The balls are periodically released by rotating the entire hopper, including its complete charge of balls.

Our improved ball feeding apparatus overcomes the problems described above by controllably feeding balls from a ball storage hopper into a small rotating discharge drum having ball compartments. The drum is operated at a predetermined speed to uniformly feed a few balls at a time into a grinding mill. As a ball charge is emptied from each compartment, the drum rotates an empty compartment into an in-line relationship with the ball storage hopper for refilling with a new charge of balls.

BRIEF SUMMARY OF THE INVENTION

The invention relates to an apparatus for uniformly feeding grinding balls into a ball mill. The apparatus includes a ball storage hopper from which new balls are supplied, a regulator, and a chute which conveys new grinding balls from the storage hopper to the regulator. The chute includes a baffle for controlling the level of grinding balls to the regulator. The regulator includes a discharge drum having a plurality of compartments which are adapted to receive grinding balls, a means for rotating the drum, and a means for retaining balls which is disposed adjacent to a portion of the drum for retaining grinding balls in the adjacent compartment. The drum is rotated at a predetermined speed, thereby feeding grinding balls into a mill at a uniform rate which can be controlled to substantially match the attrition rate of the balls in the mill.

It is a principal object of our invention to provide an improved apparatus for uniformly feeding grinding balls into a grinding mill.

An advantage of our invention is that it is inexpensive to build and operate because of its compact size and maintenance free operation. A further advantage of our invention is the minimal energy required to operate it.

The above and other objects, features and advantages of our invention will become apparent upon consideration of the detailed description and appended drawing.

DETAILED DESCRIPTION OF THE PREFERRED EMBODIMENT

Figure 1:
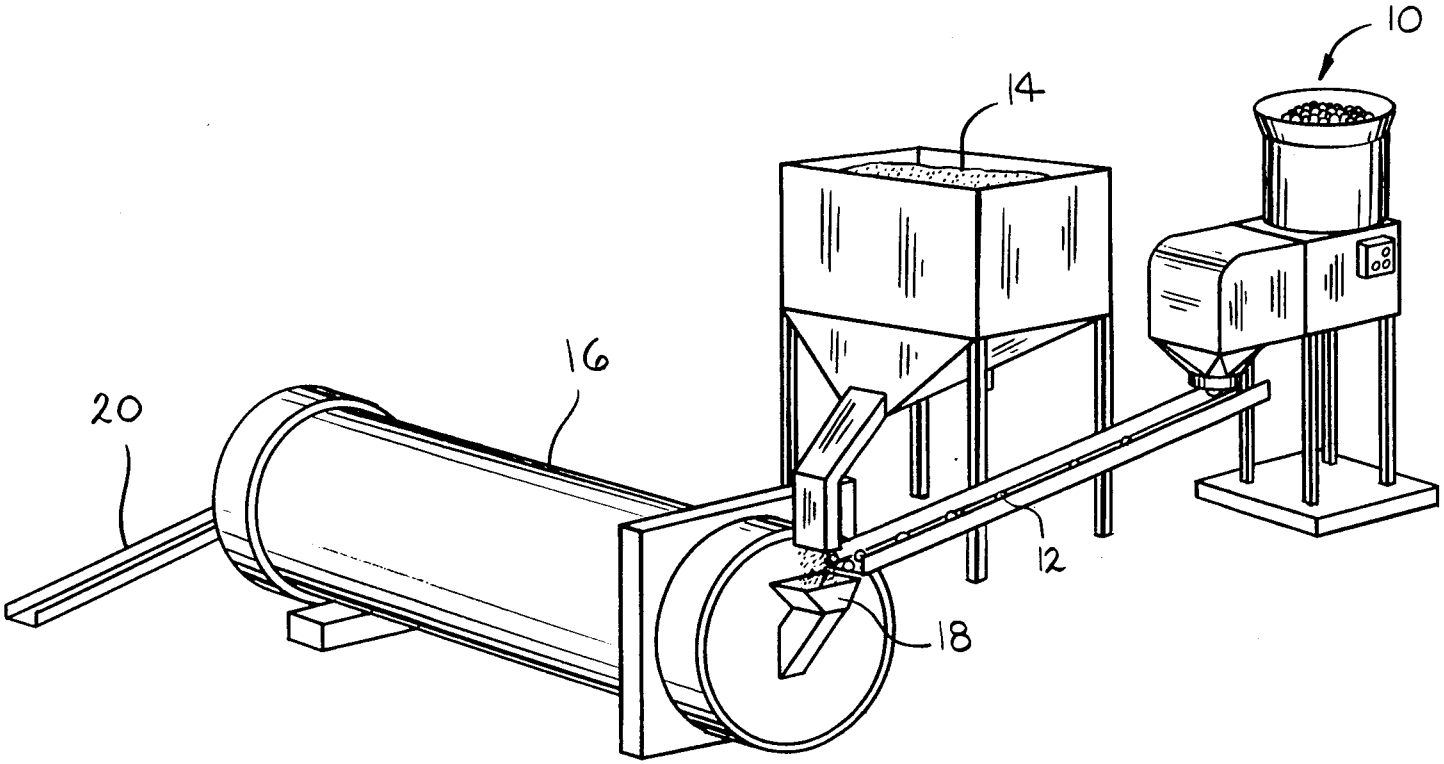
FIG. 1 is a view of our ball feeding apparatus incorporated in a grinding system.

Referring to FIG. 1, reference numeral 10 denotes our ball feeding apparatus used in a grinding system. As is well known, grinding balls 12 and raw ore 14 to be pulverized are fed into an entry end 18 of a generally horizontal, cylindrical grinding mill 16. Grinding mill 16 is normally rotated using an electric motor and conventional ring and pinion gearing (not shown). As mill 16 rotates, ore 14 is eventually pulverized by the cascading action of the tumbling balls and the pulverized ore exits mill 16 onto a conveyor 20. Unlike the prior art where grinding balls are periodically added as a batch of several hundred pounds, our device 10 uniformly adds grinding balls 12 to grinding mill 16 which can be controlled to substantially correspond to the attrition rate of the grinding balls in grinding mill 16.

Figure 2:
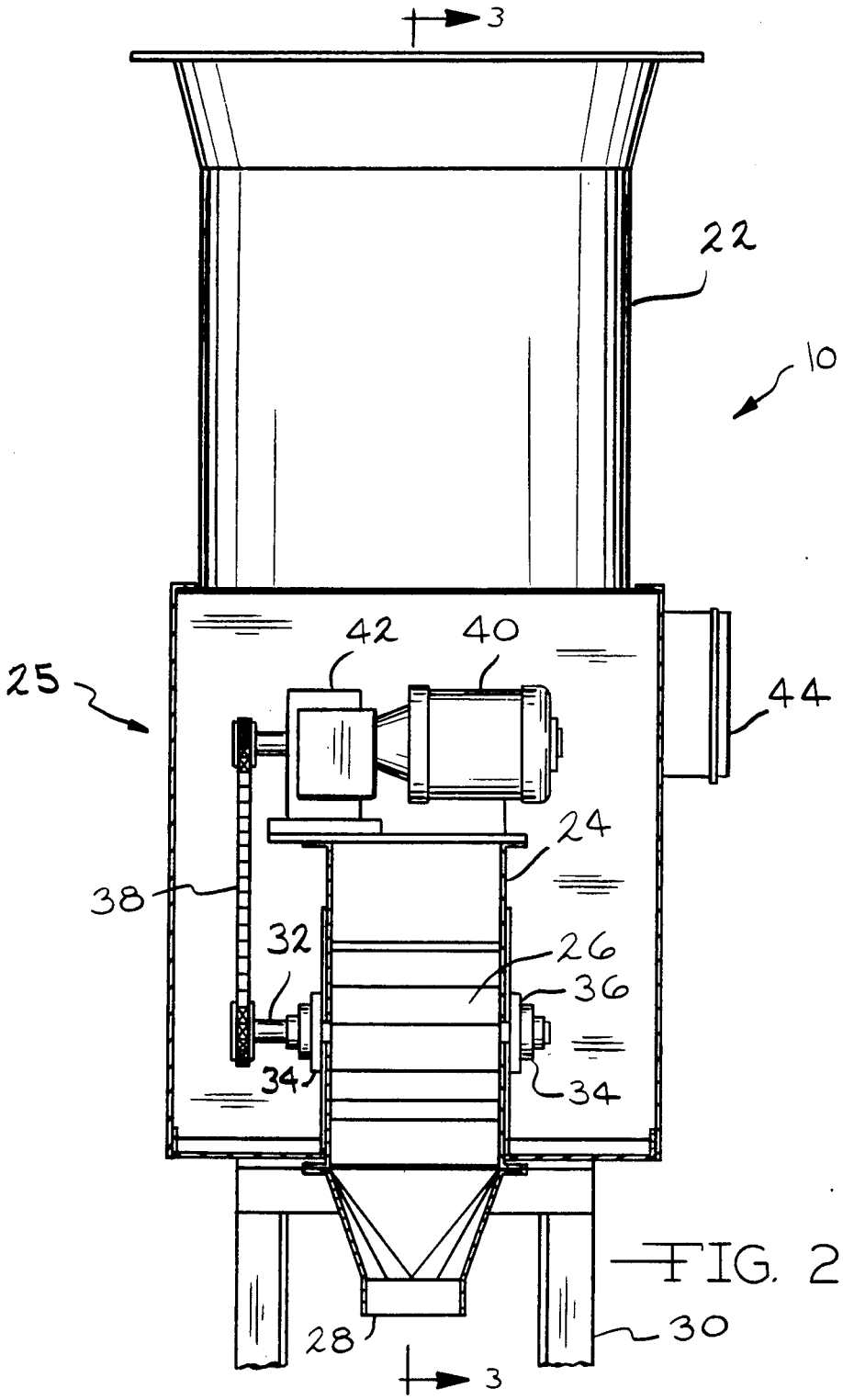
FIG. 2 is an end view of our ball feeding apparatus.

FIG. 2 shows an end view of feeding apparatus 10 mounted on legs 30. Feeding apparatus 10 includes a hopper 22 from which new grinding balls 12 are supplied, a regulator 25 for dispensing balls 12 to mill 16 through an outlet 28, and a chute 24 which conveys balls 12 from hopper 22 to regulator 25. Regulator 25 includes a discharge drum 26 mounted on a shaft 32 journalled in bearings 34 and rotated by an electric motor 40 through a drive chain 38. In the event drum 26 should ever become jammed, breakage of shaft 32 or chain 38 is prevented by incorporating a torque limiting device 36 as is well known. We have determined that a conventional 1750 RPM, ¼ HP DC motor 40 is quite satisfactory for operating drum 26. The speed of motor 40 is reduced by a conventional reducer 42 having a gear reduction ratio of 2500:1. The actual speed of drum 26 is set and monitored using a conventional speed controller 44.

Figure 3:
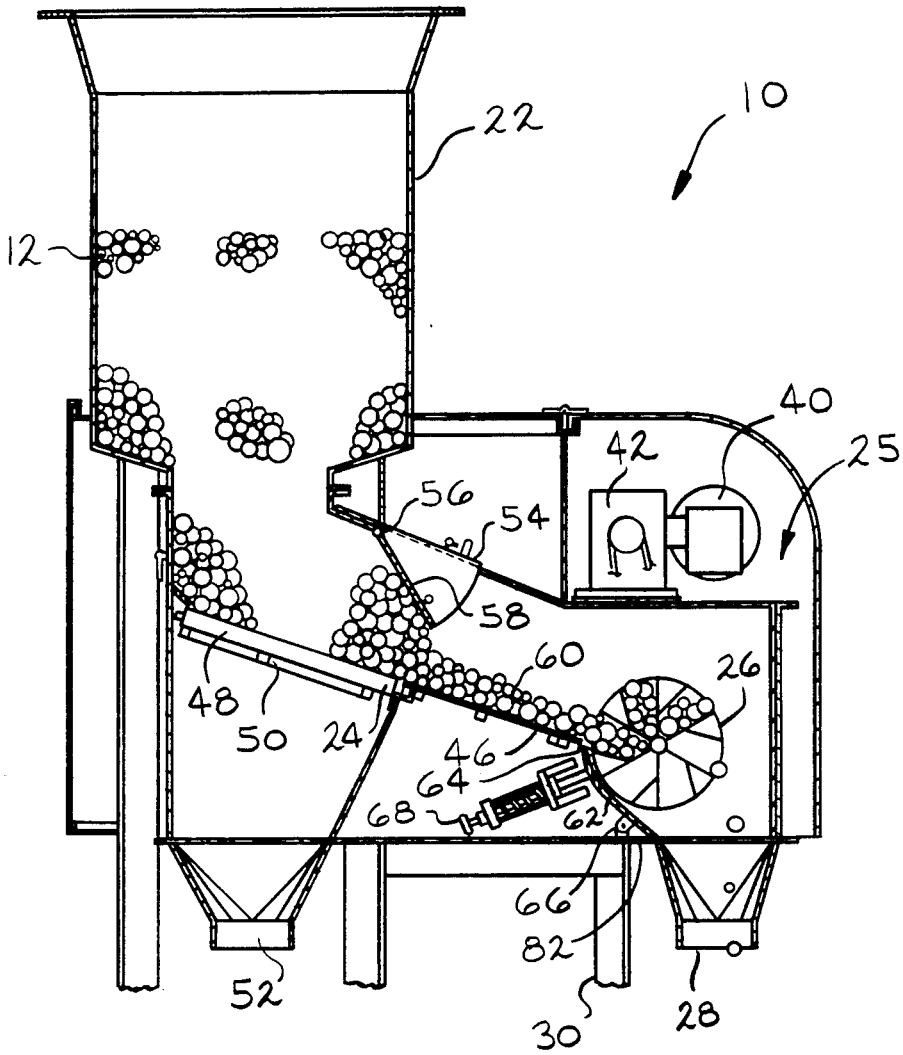
FIG. 3 is a sectional view taken along line 3—3 of FIG. 2.

FIG. 3 shows a sectional view of ball feeding apparatus 10 taken along line 3—3 in FIG. 2. Chute 24 includes a lower end 46 positioned adjacent drum 26 and an upper end 48 positioned to and below hopper 22 for receiving grinding balls 12. Chute 24 includes a grating 50 for allowing refuse such as metal fragments, ball fragments, dirt and the like to be removed through an outlet 52. A baffle such as metal panel 54 is hinged at 56 for regulating the depth of grinding balls 12 on chute 24. The depth of grinding balls 12 must be controlled so that a relatively thin layer 60 of balls 12 is metered into drum 26 via chute 24. Depending on the slope, length and width of chute 24, an unrestrained flow of balls 12 from hopper 22 could cause balls 12 to bridge across chute 24 or pile up onto and thereby prevent rotation of drum 26. If panel 54 does not sufficiently control the depth 60 of balls 12, weights may be added as necessary to face 58 of panel 54.

One of the advantages of our feeding apparatus is the elimination of mechanical means such as conveyors for delivering grinding balls 12 to drum 26. To this end, chute 24 is inclined toward drum 26 to allow gravitational feeding of balls 12. We have determined chute 24 should have a slope of at least about 5°, preferrably at least 10° with 18° being most preferred. The lower slopes are less desirable because additional means such as vibrators may be required to cause flow of balls 12 through chute 24 to drum 26.

Regulator 25 further includes a means for retaining the balls such as plate 62 having an upper end 64 and a lower end 66. Plate 62 is positioned adjacent to an below lower end 46 of chute 24 and maintained adjacent to a portion of the underside of drum 26 by a restraining means 68. Details as to the purpose and operation of plate 62 and restraining means 68 are provided later.

Figure 5:
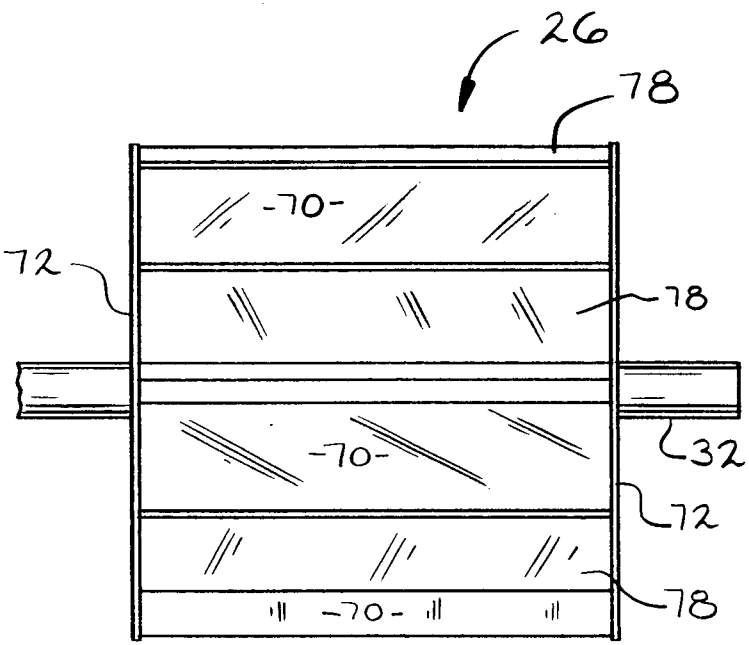
FIG. 5 is a longitudinal view of the discharge drum shown in FIG. 4.
Figure 4:
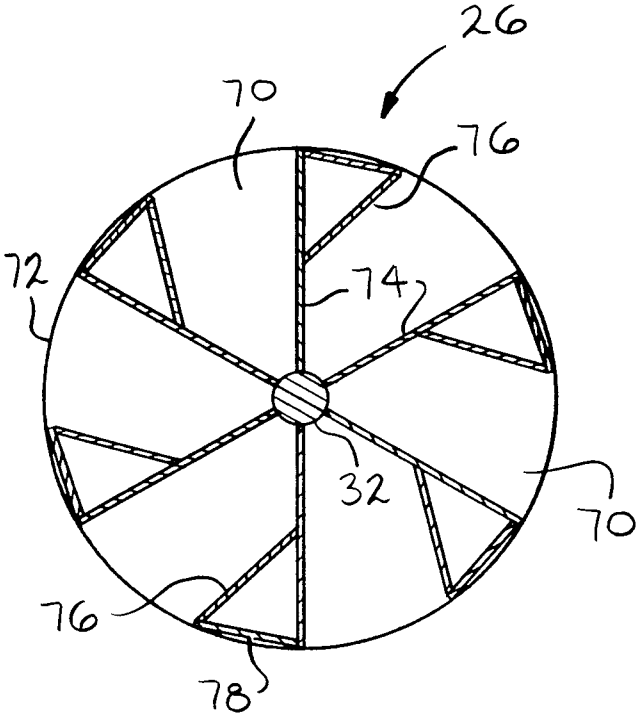
FIG. 4 is an enlarged view of the discharge drum shown in FIG. 3.

FIGS. 4 and 5 provide details for the construction of drum 26. Drum 26 includes a plurality of compartments 70 whose lateral sides are formed by discs 72 mounted on shaft 32 and whose radial sides are formed by radially extending blades 74 mounted on shaft 32. Compartments 70 are evenly separated by facing plates 78. As will be explained later, it is very desirable for compartments 70 to include a means for deflecting dynamic forces such as plates 76.

Figure 6:
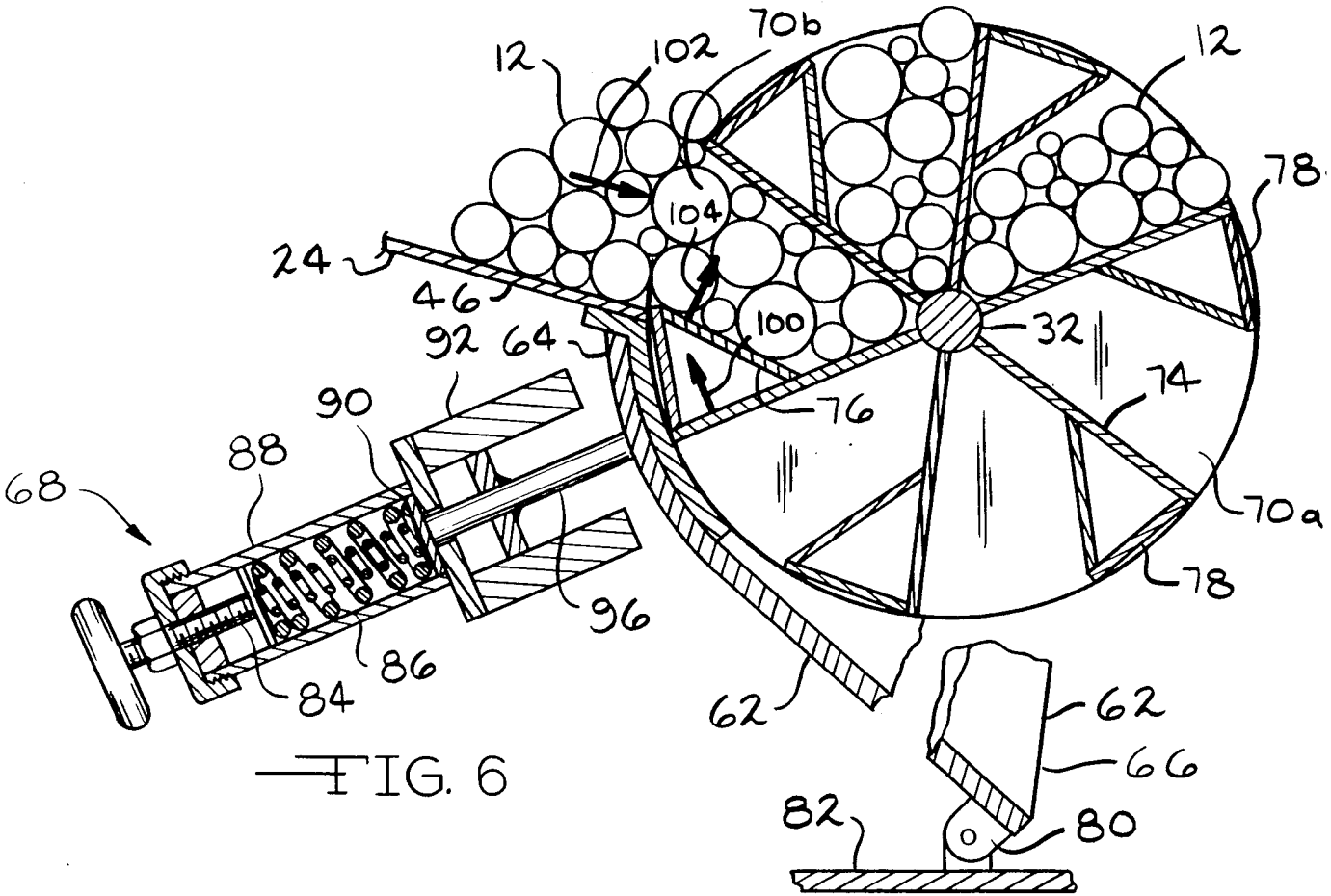
FIG. 6 is an enlarged sectional view from FIG. 3 of the discharge drum illustrating details of a preferred embodiment of our invention.

FIG. 6 shows in detail construction of a preferred embodiment for plate 62. As compartment **70*a* is releasing its charge of balls 12 to grinding mill 16, compartment 70*b* is rotated into position to receive balls from chute 24. Balls roll into compartment 70*b* as the upper right hand portion of compartment 70*b* is being rotated past lower end 46 of chute 24. Plate 62 prevents balls 12 from falling from the lower left hand portion of compartment 70*b* until face 78 is rotated past end 46 of chute 24**.

As indicated above, refuse such as metal scraps may pass along with grinding balls 12. The metal scraps may adhere to drum 26. If plate 62 is rigid, the metal scraps may become lodged between plate 62 and facing plates 78 causing drum 26 to become jammed. We have determined this problem can be overcome by fastening only lower end 66 of plate 62 by a connector 80 to a frame member 82.

Upper end 64 of plate 62 is biased into abutment with a lower portion of the peripheral surface of compartment **70*b* of drum 26 by restraining means 68. Restraining means 68 includes a screw 84 for adjusting the compression, if necessary, of a spring 86. Screw 84 and spring 86 are contained inside a tube 88 which is welded to a body portion 92. A piston 96 is connected to a spacer 90 for compressing spring 86 with piston 96 extending through body portion 92. Piston 96 is biased into abutment with upper end 64 of plate 62 by spring 86. Restraining means 68 is anchored against movement by connecting (not shown) body portion 92 to a frame member of apparatus 10. When a piece of refuse lodges between plate 62 and one of faces 78 of drum 26, upper end 64 of plate 62 is displaced away from face 78, thereby causing spacer 90 via piston 96 to compress spring 86. As the piece of refuse is freed from upper end 64 of plate 62 by further rotation of drum 26, upper end 64 is again urged against the peripheral surface of drum 26 by piston 96**.

If feeding apparatus 10 is used to process ores such as iron ore (magnetite), the steel components of apparatus 10 may become magnetized. Iron scraps become more prone to sticking to drum 26 and plate 62. In such an application, it would be desirable to fabricate chute 24, drum 26 and plate 62 from austenitic (non-magnetic) steel such as 300 series stainless steel. Any iron scraps passing through chute 24 would be more likely to be discharged through outlet 28 and not become jammed between plate 62 and drum 26.

Depending on the depth of balls 60, as well as the width and slope of chute 24, considerable force 102 is directed toward drum 26. An equal and opposing dynamic force is provided by drum 26. Without plate 76, a large porton of this opposing force 100 would be directed toward balls 12 on chute 24. However, plate 76 redirects this force component along direction 104. Preferably, plate 76 is parallel to end 46 of chute 24 as compartment **70*b* is filled with balls 12 as shown in FIG. 6. By establishing maximum opposing dynamic force 104 in a tangential direction relative to chute 24, the load on drum 26** is minimized.

An example will now be provided to further illustrate our invention. It is well known the attrition rate of grinding balls varies with the type of ore being processed as well as the metallurgical characteristics of the balls themselves. Nevertheless, the approximate wear rate for a given type grinding ball in a given mine can be determined over a period of time from production records.

A variety of grinding ball sizes are used depending upon the ore to be pulverized. Balls as small as 1 inch (25 mm) or smaller and up to about 5 inches (127 mm) may be used. Normally, a mixture of ball sizes will be used. A 50-25-25 mix comprising about 50% 2 inch (51 mm) balls, 25% 1½ (38 mm) balls and 25% 1 inch (25 mm) balls is fairly common for iron ore grinding. For drum 26 shown in FIGS. 4 and 5 having a width and diameter of about 10 inches (255 mm) and 6 compartments, the approximate delivery rates were determined as shown in the following table:

| Controller Setting | Delivery Rate For 50-25-25 Grinding Balls |
|---|---|
| 20% | 150 lb/hr (330 kg/hr) |
| 30% | 250 lb/hr (550 kg/hr) |
| 40% | 315 lb/hr (695 kg/hr) |

-continued

| Controller Setting | Delivery Rate For 50-25-25 Grinding Balls |
|---|---|
| 60% | 500 lb/hr (1100 kg/hr) |
| 80% | 720 lb/hr (1585 kg/hr) |

For an iron ore grinding operation using the above described mix of Armco high chromium cast grinding balls, it had previously been determined the ball attrition rate was approximately 280 lb/hr. (615 kg/hr). Using a gear reduction ratio of 2500:1 for the previously described motor 40, controller 44 would be set at approximately 35% to correspond to this feed rate. It was observed this setting caused the drum 26 to make one full revolution in about nine minutes. Therefore, one revolution of drum 26 would feed approximately 42 lb (92 kg) of grinding balls to grinding mill 16. Each compartment 70 would correspond to 1/6 revolution or 7 lb (15 kg) of grinding balls being fed about every 1½ minutes.

It has been demonstrated that our compact drum 26 can uniformly feed a few grinding balls at a time into a grinding mill. Once the ball attrition rate has been determined, balls in a grinding mill can be replenished at a rate to substantially correspond to that attrition rate. Peak grinding efficiency can be insured since a constant ratio of mass of balls to mass of ore to be pulverized is maintained. Furthermore, very little energy is required since the total mass of balls held by drum 26 is minimized.

While only one embodiment of our invention has been described, it will be understood by those skilled in the art various modifications can be made to our invention without departing from the spirit and scope of it. For example, the size of the drum, the number of compartments in the drum, the gear reduction ratio of the reducer and the size and mix of grinding balls required may all be varied. Of course, any variation may require different controller settings so that ball feed rates that can match the ball attrition rate for a specific grinding operation. The primary consideration will be the attrition rate of the balls from the particular raw material to be pulverized. Therefore, the limits of our invention should be determined from the appended claims.

We claim:

1. An apparatus for feeding grinding balls into a ball mill comprising:

a ball storage hopper for new grinding balls, a regulator, a chute for conveying said balls to said regulator, said chute having first and second ends, said first end including a baffle for controlling the depth of said balls on said chute, said regulator including a discharge drum, means for continuously rotating said drum and a means for retaining said balls in said drum, said drum being disposed adjacent said second end and including a plurality of compartments adapted to receive said balls, said retaining means being disposed adjacent to a portion of said drum for retaining said balls in one of said compartments, whereby said drum is rotated at a predetermined speed to uniformly feed said balls into said mill at a rate that can correspond to the ball attrition rate of said mill.

2. An apparatus as set forth in claim 1 wherein said chute is inclined toward said drum at a slope of at least 50°.

3. An apparatus as set forth in claim 2 wherein said chute has a slope of at least 10°.

4. An apparatus as set forth in claim 3 wherein said chute has a slope of 18°.

5. An apparatus as set forth in claim 1 wherein said baffle is a hinged panel, the weight of said panel controlling said depth of said balls.

6. An apparatus as set forth in claim 1 wherein said retaining means is a curved plate.

7. An apparatus as set forth in claim 6 wherein the upper end of said plate can move from a first position normally adjacent said drum to a second position spaced away from said drum.

8. An apparatus as set forth in claim 6 wherein the upper end of said plate is biased into abutment with a lower portion of said drum.

9. An apparatus as set forth in claim 1 wherein said compartments are formed by radially extending blades.

10. An apparatus as set forth in claim 9 wherein said compartments include a force deflection means.

11. An apparatus as set forth in claim 1 wherein said compartments include a force deflection means.

12. An apparatus as set forth in claim 1 wherein the output of said rotating means is substantially reduced by a gear reducer.

13. An apparatus as set forth in claim 1 further including a controller, said controller used to adjust and monitor the speed of said drum.

14. An apparatus as set forth in claim 1 wherein said compartments are evenly spaced around the periphery of said drum.

15. An apparatus for feeding grinding balls into a ball mill comprising:

a ball storage hopper for new grinding balls, a regulator, an inclined chute for conveying said balls to said regulator, said chute having first and second ends, said first end including a baffle for controlling the depth of said balls on said chute, said regulator including a discharge drum, a means for continuously rotating said drum and a means for retaining said balls in said drum, said drum disposed adjacent said second end and including a plurality of evenly spaced compartments adapted to receive said balls, said compartments formed by radially extending blades and a force deflection means, said retaining means including a curved plate which is biased into abutment with a lower portion of said drum for retaining said balls in one of said compartments, whereby said drum is rotated at a predetermined speed to uniformly feed said balls into said mill at a rate that can correspond to the ball attrition rate of said mill.

* * * * *